United States Patent [19]

Kunczynski

[11] Patent Number: 4,470,355

[45] Date of Patent: Sep. 11, 1984

[54] PNEUMATIC CABLE TENSIONING APPARATUS AND METHOD FOR AN AERIAL TRAMWAY OR THE LIKE

[76] Inventor: Jan K. Kunczynski, Boulder Cove, Box 256, Glenbrook, Nev. 89413

[21] Appl. No.: 851,159

[22] Filed: Nov. 14, 1977

[51] Int. Cl.[3] ..... B61B 12/00

[52] U.S. Cl. ..... 104/196; 104/117; 104/178; 187/22; 198/813; 242/147 R; 254/277; 254/392; 474/110

[58] Field of Search ..... 104/112, 114, 117, 173 ST, 104/178, 196; 254/172, 175.3, 277, 392; 187/22; 198/813; 242/147 R, 155 R, 155 BW; 74/242.8, 242.9; 474/110, 103, 104

[56] References Cited

U.S. PATENT DOCUMENTS

| | | | |
|---|---|---|---|
| 888,439 | 5/1908 | Hibbard | 104/196 |
| 1,281,323 | 10/1918 | Ferris et al. | 104/117 |
| 2,986,267 | 5/1961 | Carlson et al. | 198/813 X |
| 3,208,728 | 9/1965 | Parks | 254/172 |
| 3,377,959 | 4/1968 | Hawes | 104/117 |
| 3,661,090 | 5/1972 | Martin et al. | 104/117 X |
| 3,743,249 | 7/1973 | Van Daalen | 254/172 |
| 3,809,832 | 5/1974 | Burger | 104/178 X |
| 3,951,073 | 4/1976 | Sowder | 104/117 |
| 3,987,735 | 10/1976 | Lofink | 254/172 X |
| 4,003,314 | 1/1977 | Pearson | 104/173 ST X |
| 4,025,055 | 5/1977 | Strulenberg | 254/172 |
| 4,037,823 | 7/1977 | Thaeter et al. | 254/172 |
| 4,046,355 | 9/1977 | Martin | 254/172 X |
| 4,072,122 | 2/1978 | Balston | 254/172 |

*Primary Examiner*—Randolph Reese

*Attorney, Agent, or Firm*—Manfred M. Warren; Robert B. Chickering; Glen R. Grunewald

[57] ABSTRACT

A cable tensioning apparatus and method for automatically maintaining and adjusting the tension forces in an endless cable for a ski lift, aerial tramway, etc. is disclosed. The apparatus includes a carriage on which the cable is carried, a pneumatic carriage displacement apparatus in the form of a piston and cylinder, a source of gas under pressure, and a regulator and relief valve connected to establish and maintain a pressure within the cylinder which falls between predetermined minimum and maximum pressures. As the aerial tramway is subject to passenger or cargo loading and ambient conditions which change the tension forces, the pressure in the pneumatic cylinder will vary within the preselected range, and upon a change in the tension force beyond the range, gas is automatically exhausted from or interjected into the pneumatic cylinder to maintain tension forces within the preselected range.

2 Claims, 1 Drawing Figure

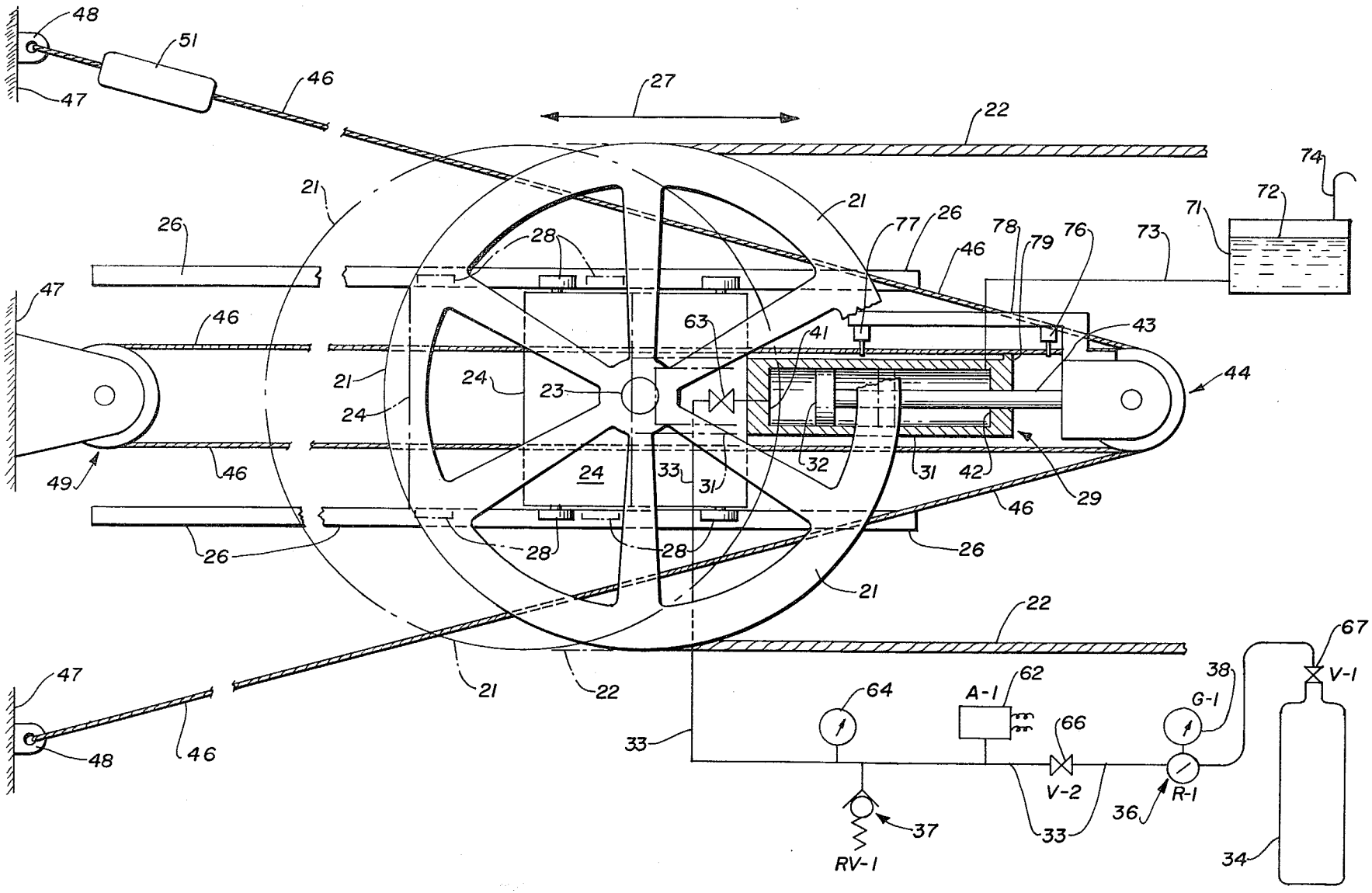
V-1
V-2
G-1
R-1
A-1
RV-1

PNEUMATIC CABLE TENSIONING APPARATUS AND METHOD FOR AN AERIAL TRAMWAY OR THE LIKE

BACKGROUND OF THE INVENTION

The tension in an endless drive cable of the type used to drive an aerial tramway (e.g., chairlift, gondola, tram), ski lift or the like must be kept within certain ranges for efficiency and safety of operation. Drive cables are subjected to a wide range of conditions which affect the tension forces in the cable. The passenger load on a drive cable can vary from essentially the weight of the cable and the chairs, gondolas, etc. to a fully loaded condition Moreover, these loads and the tension forces in the cable are periodically varying as passengers and/or cargo load and unload from the aerial tramway. Still further, aerial tramways may be called upon to operate under widely varying temperature conditions, e.g., from 60° to 70° F. during summer time operation, or even higher, down to −10° to −20° F., or even lower, during winter operation.

Perhaps the most often employed method of adjusting the tension in the endless drive cable in an aerial tramway or the like is to mount one of the bull wheels of the tramway on a carriage that is movable in a direction enabling elongation or relaxation of the cable. Most usually the carriage for the bull wheel is attached to a large counterweight which applies a constant force to the carriage, and accordingly the cable. U.S. Pat. No. 3,951,073 is a good example of a counterweight cable tensioning system for a chairlift.

There are, however, certain drawbacks to use of a counterweight tensioning apparatus. First, the counterweight often has to be undesirably massive and unwieldy, for example, as large as a sixteen ton block of concrete. Second, it is sometimes necessary or desirable to be able to raise or lower the vertical height of the horizontal bull wheel. Such raising and lowering can dramatically change the relationship with respect to the counterweight and the bull wheel or require raising and lowering of the counterweight and its support structure, a difficult task. Third, while the counterweight system theoretically induces a constant tension force in the cable, substantial problems have been encountered with the counterweight pulleys, guides and the like becoming frozen or their movement otherwise impeded under the adverse environmental conditions, and the system inherently has high inertia and slow reaction time to dynamic loads.

Another approach has been to drive the movable carriage to which the horizontal bull wheel is mounted by a hydraulic cylinder so as to enable variation of the tension forces in the drive cable by hydraulics. U.S. Pat. No. 3,377,959 is typical of this type of approach. While hydraulic systems have the advantage of avoiding the mass of large counterweight systems, they also have substantial disadvantages. Hydraulic systems are basically closed systems in which the hydraulic fluid must be periodically pumped into the cylinder, with the excess fluid returning to a reservoir for later use. Thus, the system must have a periodically operating pump, and under many aerial tramway regulating codes, there must be an auxiliary pump to back up the first pump in the case of failure. Such hydraulic systems can be operated manually or by automatic controls. Manual systems lead to the undesirable buildup of tension forces in the cable, while automatic hydraulic controls are inherently relatively complex and less sensitive than is otherwise desirable. In hydraulic systems, the imcompressibility of the hydraulic fluid can result in reaction times in the system which are far slower than the dynamic loading conventionally experienced by the cable. U.S. Pat. No. 3,987,735 is an example of a hydraulic cable tension controlling system for railroad car spotting. While adequate for its purposes, this system is not suitable for nor designed to be employed in a tramway cable tensioning maintenance and control system.

Some attempts have been made to enhance hydraulic systems by adding a gas-over-fluid approach, such as is shown in U.S. Pat. No. 888,439 or even an air bladder in combination with the hydraulic fluid to attempt to cushion shock loading. These systems are still faced with the problems of complex automatic controls, multiple pumps and leakage of the hydraulic fluid from the system, because the gas is used as a shock absorber, but not the basic working medium.

Pneumatic apparatus have been previously employed as part of a variety of non-aerial tramway systems which employ cable under tension. These systems often do not experience the same wide range of loading conditions as does an aerial tramway system,and the pneumatic apparatus have accordingly been designed to accomplish different functions. In U.S. Pat. No. 1,281,323, for example, a steam actuated cylinder provides a tension force on a cable, which when overcome, allows displacement of a pulley system to indicate that a tower is in danger of tipping over. In U.S. Pat. No. 3,661,090 a pneumatic cylinder is employed in connection with a cable system to act essentially as a shock absorber. Tension adjustment is achieved through a complex winching system.

SUMMARY OF THE INVENTION

A. Objects of the Invention

Accordingly, it is an object of the present invention to provide a cable tensioning apparatus suitable for use in the maintenance and automatic adjustment of tension forces in an aerial tramway drive cable which will maintain these forces within a predetermined range for safe and economical operation of the tramway.

Another object of the present invention is to provide a cable tensioning apparatus and method which is highly responsive to dynamic tension inducing forces on the drive cable and yet is capable of absorption of dynamic loading without constant adjustment and operation of automatic controls.

Still another object of the present invention is to provide a cable tensioning apparatus and method in which a pneumatic system is employed to provide simplicity of control of the tension force, quick response to dynamic loads and a shock loading capacity.

Still a further object of the method and apparatus of the present invention is to provide a cable tensioning system which is compact in nature, has a minimum of moving parts, is inexpensive to construct as well as operate, is operable under a wide range of environmental conditions, has greater reliability and is less susceptible to leakage or system failure, and can have a duplicate or back-up system where required by code.

The method and apparatus of the present invention have other objects and features of advantage which will be set forth in more detail in and will become apparent from the following description of the preferred embodiment and the accompanying drawing.

B. Brief Summary

The cable tensioning apparatus of the present invention includes a movable carriage upon which the cable to be tensioned is mounted and carriage displacement means formed and supported to displace the carriage in a direction causing tensioning of the cable. The improvement of the present invention comprises, briefly, the carriage displacement means being provided as a pneumatic carriage displacement means connected to a source of gas under pressure, and regulator means formed and connected to establish and automatically maintain a minimum gas pressure within the pneumatic carriage displacement means, and relief valve means formed and connected to automatically prevent the buildup of gas pressure in the pneumatic carriage displacement means above a maximum pressure. The minimum and maximum gas pressures are selected to cause tension forces in said cable to fall within a predetermined range of forces. Preferably, the source of gas is provided by a nitrogen cylinder, and the system further includes an alarm indicating low pressure, a flow control valve preventing rapid depressurization, and a shut-off valve enabling maintenance of pressure in the system during replacement of the gas source. Additionally, a method of maintaining the tension forces in an endless aerial tramway cable is provided wherein the improvement is comprised, briefly, of employing a compressible fluid under pressure in the carriage displacement means and periodically adding compressible fluid when the pressure reaches a minimum level and periodically discharging the fluid when the pressure reaches a maximum level.

DESCRIPTION OF THE DRAWING

The figure is a top plan view, partially shown as a schematic representation, of cable tensioning apparatus constructed in accordance with the present invention for use in tensioning an aerial tramway.

DESCRIPTION OF THE PREFERRED EMBODIMENT

The cable tensioning apparatus of the present invention can be employed at either end of an aerial tramway or ski lift line and can be used with either a drive wheel or an idler wheel. As shown in the figure, therefore, the horizontal bull wheel 21 can be located at the top or bottom end of the endless cable 22, and it is mounted for rotation about shaft 23, which may be driven by a drive motor (not shown) or can be an idler shaft. Cable 22 is received and supported for movement on pulley means intermediate top and bottom bull wheels in a conventional manner, and personnel-conveying or cargo-conveying chairs, gondolas, etc. are affixed to the drive cable for movement therewith.

In order to provide for adjustment of the tension in cable 22, bull wheel 21 may be mounted by shaft 23 to movable carriage means 24, which in turn is mounted for reciprocal motion on carriage guide means or rails 26 in a direction indicated by arrows 27. Movable mounting of carriage 24 to guide means 26 can be accomplished in a number of different manners, but as shown in the drawing, carriage 24 is provided with roller elements 28 which engage the top and the bottom (not shown) of rails 26.

Displacement of carriage 24 is effected by carriage displacement means, generally designated 29, which is supported from a stable support surface (in a manner which will be set forth in detail hereinafter) and coupled to carriage 24 for displacement thereof. As thus far described, the cable tensioning apparatus of the present invention includes elements which are present in the prior art, and these elements are not considered to be a novel part of the present apparatus.

The cable tensioning apparatus of the present invention, however, is formed to automatically maintain and adjust the tension force in cable 22, to accommodate tension force changes within a preset or predetermined range, and to be capable of high speed reaction to dynamic loading conditions. This is accomplished in the improved cable tensioning apparatus by providing carriage displacement means 29 as a pneumatically actuated carriage displacement means including pneumatic cylinder 31 and piston 32 connected by conduit means 33 to a source of gas 34 under pressure. Moreover, the pneumatic carriage displacement means of the present invention also includes valve means comprising regulator means 36 and relief valve means 37, coupled by conduit means 33 in a manner affecting the pressure in cylinder 31. The regulator means 36 is formed and connected to establish a minimum gas pressure in cylinder 31, and preferably is selectively adjustable. The minimum gas pressure communicated from source 34 to cylinder 31 is measured by gauge 38, and as will be apparent, the source 34 should have a gas pressure in excess of the minimum which is preset by regulator 36.

In addition, the relief valve means 37 is formed and connected by conduit 33 in a manner to limit or prevent the buildup of pressure in cylinder 31 above a maximum preset or predetermined pressure. The maximum pressure at which relief valve 37 is operable is selected to be greater than the minimum pressure established by regulator means 36. It is also possible to combine the regulating and relieving functions in a single device such as a so-called "relieving regulator."

Determination of the minimum pressure established by regulator 36 and the maximum pressure established by relief valve 37 is dependent upon the geometry of the pneumatic carriage displacement means 29. Thus, the area of piston 32 and the pressure in cylinder 31 will determine the force applied by the pneumatic displacement means 29 against carriage 24, which in turn determines the tension forces generated in cable 22. As will be apparent, therefore, the regulator 36 and pressure relief valve 37 can be preset so that the tension forces in cable 22 will always fall within a minimum and maximum tension force determined by the minimum or maximum pressure which will be maintained in cylinder 31.

It is an important feature of the present invention that the minimum and maximum pressure can be set so that for most loading conditions, dynamic or otherwise, the gas is not flowing from source 34 into cylinder 31 or from the cylinder out of the system. It is contemplated, therefore, that the minimum and maximum pressures will be set so that as tension forces change in cable 22, the relative positions of the piston and cylinder will move, changing the pressure inside the cylinder, but the movement for most conditions will not be so great as to change the pressure inside the cylinder to an extent causing it to drop below the minimum or pass above the maximum pressure.

In the pneumatic cable tensioning apparatus of the present invention, the tension in cable 22 does not remain constant, as would theoretically be the case with a counterweight system. Instead, the tension forces in cable 22 will vary, but this variation is limited to a range of values which are known to be safe and to enable efficient operation of the tramway. The compressibility of the gas in cylinder 31 is employed, not only for its shock loading capability, but also to enable maintenance of tension forces within a limited range without the need for the constant control or adjustment, which is required for hydraulic systems with their attendant complex and expensive automatic controls. This ability of the cylinder and piston to work on the compressible gas, as well as the ease with which a regulator and relief valve can be used to immediately add or exhaust gas from the piston and cylinder, provides a highly responsive cable tension maintenance and adjustment system so that when unusual dynamic loading occurs the tension forces in the cable cannot build up so rapidly that the safety of the passengers is in any way endangered.

In operation, the buildup of tension forces in cable 22 will cause the carriage 24 to move to the right, as viewed in the figure, and the piston and cylinder will compress the gas contained therein until the pressure exceeds the maximum value established by relief valve 37, at which point pressure is relieved enabling further movement of the carriage to the right and accordingly a decrease in the tension in cable 22. If a stress reversal in the cable is thereafter encountered, the cable goes slack, and the carriage will tend to move to the left, reducing the pressure in cylinder 31. If the pressure is reduced below the value established by regulator 36, the regulator will permit the flow of more gas to the cylinder from source 34 until the carriage is displaced to the left, as shown in phantom, a sufficient distance to bring the tension in cable 22 up to a predetermined minimum level. The response of the system is fast enough so that the tension can never drop below the minimum or exceed the maximum by any significant amount for any significant period of time. The flow through the regulator and the relief valve to and from the piston and cylinder can be essentially instantaneous.

Pneumatic adjustment means 29 preferably is initially set at a minimum pressure with piston 32 relatively close to the end wall 41 of cylinder 31, because there is a tendency for the cable 22 to gradually stretch with time, requiring displacement of carriage 24 to the left. Thus, after the minimum pressure is established in cylinder 31, the piston will work against the compressible fluid with occasional peak loads resulting in discharge through relief valve 37, but more frequently some additional gas will be introduced into the cylinder and the carriage will be displaced to the left to insure a minimum tension in cable 22. Over a period of time, piston 32 will approach the opposite end wall 42 of the cylinder, which will require periodic movement of the relative positions of the piston and cylinder from the extended position of the piston (proximate end wall 42) to the retracted position of the piston (proximate end wall 41).

Movement of the relative positions of the piston and cylinder from an extended position to a retracted position and support of the pneumatic adjustment means so that it will displace carriage 24 in the desired manner can be accomplished in a number of different ways. In the apparatus of the figure, the end 43 of piston 32 is coupled to pulley means 44, which in turn is coupled by cable 46 to stationary support surfaces 47. Support surfaces 47 may be part of the frame to which the bull wheel assembly and rails 26 are mounted. In the drawing, cables 46 are mounted to the support surface through a pair of ears 48 positioned on either side of rails 26 and pulley means 49 positioned intermediate rails 26. This construction allows a single cable to be passed from a first ear 48, to pulley 44 and then to pulley 49, back to pulley 44, and finally to second ear 48. One continuous cable used in this manner has the effect of four cable diameters in terms of supporting the tension force in drive cable 22. If desired, a plurality of cables 46 can be mounted in side-by-side relation on the pulley means 44 and 49 and in turn coupled to ears 48.

With the end of the piston 43 supported from rigid support surfaces 47, it will be apparent that the introduction of gas into cylinder 31 will tend to displace the cylinder away from the rigidly supported piston 32, which in turn displaces the carriage to which the cylinder is coupled to the left. This manner of support of the piston from a frame support surface also facilitates the retraction of the relative positions of the piston and cylinder. Thus, a cable hoist 51 can be coupled to cable 46 so that the cable hoist 51 and pulley means 44 and 49 act as retraction means for the assembly. In the event that piston 32 comes close enough to end wall 42 that the stroke of the piston will not have sufficient length to accommodate dynamic loads that will be encountered, cable hoist 51 can be used to pull the piston from proximate end wall 42 to a position more closely proximate end wall 41. As the cable hoist pulls the piston toward end wall 41, the pressure in cylinder 31 will build up to a point above the maximum pressure and gas will be exhausted from relief valve 37. If during operation piston 32 should be undesirably close to end wall 41, the process can be reversed. The cable hoist is used to relax the tension in cable 46, and the pressure in cylinder 31 will move the piston to the right toward end wall 42. As the pressure in the cylinder drops below the minimum, regulator 36 will allow more gas to flow into the cylinder from source 34.

As will be readily appreciated, other structures can be employed for support of the piston for displacement of the carriage. Thus, a chain hoist system or even a hydraulic jack formed for adjustable support of the piston from a stationary support surface 47 can be used.

In order to provide increased safety in the cable tensioning apparatus of the present invention, the pneumatic system preferably includes certain additional elements. Alarm means 62 may be connected to sense pressure supplied through the conduit intermediate the regulator and relief valve so that alarm means 62 will produce an alarm signal in the event that the pressure coming from regulator 36 should drop below the minimum gas pressure.

In order to prevent a sudden relaxation of cable 22 in the event that conduit 33 should become broken or fail, it is also preferable to provide a metering or flow control valve 63 connected to conduit 33 proximate the cylinder. The flow control valve is formed so that if the conduit should become broken, it will permit flow out of the cylinder, but the flow will be slow enough so that the cable 22 will not be relaxed so fast that it will be damaged when the piston reaches wall 41.

It is also desirable for the system to include a gauge 64 which monitors the pressure inside cylinder 31. Gauge 64 can also be used to set the maximum pressure established by relief valve 37.

Additionally, the system can include an auxiliary shut-off valve 66, which allows the source of gas 34 to be isolated from the cylinder during changing of the gas source. Thus, when the pressure in source 34 drops below the minimum set by regulator 36, valve 66 can be shut off to positively insure that cylinder 31 has the desired minimum pressure, and the source of gas 34 can be changed.

It is an important further feature of the present invention that the pneumatic carriage displacement means can be driven by conventionally available bottled gases under a static pressure. More particularly, it is advantageous to employ a pressurized container of nitrogen gas as source 34. Unlike hydraulic systems, an inert gas such as nitrogen can be readily discharged from a relief valve, such as valve 37, into the atmosphere without any adverse ecological results. Similarly, leakage in a pneumatic system using an inert gas is not as critical. Such bottled gases conventionally come with their own shut-off valve 67 which enables selective coupling of the bottle to conduit 33.

Finally, in order to lubricate the movement of piston 32 in cylinder 31, a lubricant reservoir 71 having lubricant 72 therein may be coupled by conduit 73 to cylinder 31. The reservoir is preferably an open reservoir with vent tube 74 provided to vent the same to the atmosphere. The size of conduit 73 and the presence of a venting tube 74 are selected so that flow of oil to and from the cylinder from behind piston 32 does not significantly influence the displacement of the piston and more particularly does not significantly reduce the reaction time of the system to dynamic loads.

As will be appreciated, the movement of carriage 24 and the piston with respect to the rails and the frame of the bull wheel support station makes it advantageous for conduit 33 to be flexible, unless all of the pneumatic controls and the source of gas are carried by movable carriage 24. The same would be true with respect to the lubricant reservoir and conduit, although it may be more conveniently carried by the carriage for movement therewith.

In order to prevent displacement of the piston 32 to a position too close to either end walls 42 or 41, the system further preferably includes limit switch means formed and connected to sense the relative displacement of the piston and cylinder. This can be accomplished in a number of different manners including a bracket 78 to which limit switches 76 and 77 are mounted for engagement of a protrusion 79 or other portion of surface that moves with the cylinder. The limit switches can be electrically connected to an alarm and to the power source for the aerial tramway so that the tram cannot be operated when the piston is too close to either of the end walls of the cylinder.

By way of illustration and example, the following are some typical component specifications which can be used in connection with a pneumatic tension adjustment system of the present invention. An eight-inch diameter pneumatic cylinder which can withstand a maximum pressure of 7,000 lbs. can be employed with the maximum pressure in the system set by relief valve 37 being in about the 700–900 psi range. The minimum pressure established by regulator 36 is about 700 psi. Cable 22 will be typically a $\frac{5}{8}''$ diameter steel cable having a maximum designed loading strength of 41,200 lbs., but the maximum tension load during operation of the cable will be approximately 4,400 lbs., giving it a safety factor in excess of nine. The minimum tension load which the cable should withstand is about 12,000 lbs. In order to support pulley means 44 and accordingly the piston and the entire carriage 24 against movement, cable 46 can be a $\frac{5}{8}''$ diameter cable which is doubled so as to effectively provide eight cable diameters connected to support surfaces 47, and cable 46 has a maximum tensile strength of approximately 35,000 lbs. Cable hoist 51 can be a three-ton cable hoist, since the maximum tension in cable 46 should be no greater than the maximum tension in the cable 22, or approximately 4,400 lbs. The traveler's stroke of piston 32 in cylinder 31 is advantageously between about 18–24" with limit switches 76 and 77 being positioned so that the piston could never come closer than two inches to the end walls 41 and 42. The rails 26 on which the carriage is mounted may provide for carriage travel of about ten to fourteen feet, which will accommodate the normal range of movement of the carriage over many years of operation. As so constructed, the tensioning apparatus can be driven by a bottle of nitrogen gas containing about 150 $ft^3$ of nitrogen at an initial pressure of about 5,000 psi for an estimated six months before the nitrogen bottle must be replaced.

What is claimed is:

1. Cable tensioning apparatus for the automatic adjustment and maintenance of the tension forces in an endless cable for an aerial tramway or the like to within a predetermined range of forces, said apparatus including movable carriage means, said cable being mounted to said carriage means for movement therewith, pneumatically actuated carriage displacement means including a piston and a cylinder with one of said piston and said cylinder being coupled to said carriage means and said piston and said cylinder being formed and supported to displace said carriage means in a direction causing tensioning of said cable, a source of gas under pressure connected to said cylinder, adjustable regulator means formed and connected to establish and automatically maintain a selected minimum gas pressure within said cylinder, and adjustable relief valve means formed and connected to automatically prevent the buildup of gas pressure in said cylinder above a selected maximum gas pressure in excess of said minimum pressure, wherein the improvement in said tensioning apparatus is comprised of:

retraction means formed to enable periodic movement of the relative position of said piston and said cylinder as a unit from an extended position to a retracted position.

2. Cable tensioning apparatus as defined in claim 1 wherein, said retraction means is formed to provide support means for said carriage displacement means, and said retraction means is formed to urge one of said piston and said cylinder to said retracted position by a relative displacement thereof until gas pressure in said cylinder exceeds said maximum gas pressure and gas is exhausted from said cylinder through said relief valve means, and limit switch means formed and mounted to sense the relative position of said piston and said cylinder when said piston is proximate said extended and said retracted positions.

* * * * *